US009501973B2

(12) United States Patent
Sun et al.

(10) Patent No.: US 9,501,973 B2
(45) Date of Patent: Nov. 22, 2016

(54) PIXEL DRIVING CIRCUIT, DRIVING METHOD, ARRAY SUBSTRATE AND DISPLAY APPARATUS

(71) Applicant: BOE Technology Group Co., Ltd., Beijing (CN)

(72) Inventors: Liang Sun, Beijing (CN); Ying Wang, Beijing (CN); Tuo Sun, Beijing (CN); Zhanjie Ma, Beijing (CN); Xinshe Yin, Beijing (CN); Lintao Zhang, Beijing (CN); Lujiang Huangfu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 11 days.

(21) Appl. No.: 14/652,343

(22) PCT Filed: Sep. 30, 2014

(86) PCT No.: PCT/CN2014/087940

§ 371 (c)(1),
(2) Date: Jun. 15, 2015

(87) PCT Pub. No.: WO2015/188533

PCT Pub. Date: Dec. 17, 2015

(65) Prior Publication Data

US 2016/0284269 A1 Sep. 29, 2016

(30) Foreign Application Priority Data

Jun. 13, 2014 (CN) ..... 2014 1 0265298

(51) Int. Cl.
*G09G 3/3233* (2016.01)
*G09G 3/32* (2016.01)

(52) U.S. Cl.
CPC ..... *G09G 3/3233* (2013.01); *G09G 3/3258* (2013.01); *G09G 2300/0819* (2013.01); *G09G2320/0233* (2013.01); *G09G 2320/0257* (2013.01); *G09G 2320/045* (2013.01); *G09G 2320/0626* (2013.01)

(58) Field of Classification Search
CPC ..... G09G 3/3233; G09G 3/3258; G09G 2320/0626; G09G 2320/0257; G09G 2320/0233; G09G 2320/045; G09G 2300/0819
See application file for complete search history.

(56) References Cited

U.S. PATENT DOCUMENTS

2007/0040772 A1 2/2007 Kim
2014/0292740 A1* 10/2014 Tseng ..... G09G 3/3258 345/212

FOREIGN PATENT DOCUMENTS

CN 103077680 A 5/2013
CN 103226931 A 7/2013
CN 203882588 U 10/2014
JP 2005128521 A 5/2005

OTHER PUBLICATIONS

Mar. 13, 2015—(WO) Written Opinion of ISA—Intl App PCT/CN2014/087940—English Translation.

* cited by examiner

*Primary Examiner* — Premal Patel
(74) *Attorney, Agent, or Firm* — Banner & Witcoff, Ltd.

(57) ABSTRACT

A pixel driving circuit, array substrate and display apparatus, comprise: data line for providing data voltage; gate line for providing scanning voltage; first power supply line for providing first power supply voltage; second power supply line for providing second power supply voltage; light emitting device connected to second power supply line; driving transistor connected to first power supply line; storage capacitor having first terminal connected to gate of driving transistor and configured to transfer information to gate of driving transistor; resetting unit configured to reset voltage across storage capacitor as predetermined signal voltage; data writing unit configured to write information into second terminal of storage capacitor; compensating unit configured to write information into first terminal of storage capacitor; and light emitting control unit configured to write first power supply voltage into second terminal of storage capacitor and control driving transistor to drive light emitting device to emit light.

17 Claims, 2 Drawing Sheets

PIXEL DRIVING CIRCUIT, DRIVING METHOD, ARRAY SUBSTRATE AND DISPLAY APPARATUS

The application is a U.S. National Phase Entry of International Application No. PCT/CN2014/087940 filed on Sep. 30, 2014, designating the United States of America and claiming priority to Chinese Patent Application No. 201410265298.9 filed on Jun. 13, 2014. The present application claims priority to and the benefit of the above-identified applications and the above-identified applications are incorporated by reference herein in their entirety.

TECHNICAL FIELD

The present disclosure relates to a pixel driving circuit, a driving method, an array substrate and a display apparatus.

BACKGROUND

An organic light emitting diode (OLED), as a current type light emitting device, has been increasingly applied to a high-performance active matrix organic light emitting display. A traditional passive matrix organic light emitting display requires a shorter driving time of a single pixel as its display size increases, and thus requires increasing the transient current, which causes an increase of power consumption. At the same time, application of a large current would cause excessive voltage drop of an indium tin oxide metal oxide line and make the operating voltage of OLED too high, thereby reducing its efficiency. The active matrix organic light emitting display (AMOLED) scans progressively through switching transistors to input the OLED current, which can solve these problems well.

In the pixel circuit design of AMOLED, the major problem to be solved is the luminance non-uniformity of an OLED device driven by respective AMOLED pixel driving units.

First, AMOLED adopts thin film transistors (TFT) to construct a pixel driving unit to supply a corresponding driving current to the light emitting device. As known in the art, low temperature poly silicon thin film transistors or oxide thin film transistors are mostly used. Compared with a general amorphous-silicon thin film transistor, the low temperature poly silicon thin film transistor and the oxide thin film transistor have a higher mobility and a more stable characteristic, and are more suitably applicable to AMOLED display. However, due to limitation of crystallization technique, the low temperature poly silicon thin film transistor manufactured on a large-size glass substrate always has non-uniformity in electrical parameters such as threshold voltage, mobility and so on. Such non-uniformity would be converted into differences in driving current and luminance of the OLED device and sensed by human eyes, i.e., phenomenon of Mura color. Although the oxide thin film transistor has a better process, as similar as the amorphous-silicon thin film transistor, the threshold voltage of the oxide thin film transistor drift under pressure and high temperature for a long time. Since display pictures are different, the threshold voltage drift of thin film transistors in respective parts of the panel is different, which would cause difference in display luminance. Such difference is always presented as an image sticking phenomenon because it is related to images previously displayed.

Since the light emitting device of OLED is a current-driven device, in the pixel driving unit that drives the light emitting device to emit light, the threshold characteristic of its driving transistor has a great impact on the driving current and the final displayed luminance. The driving transistor would make its threshold voltage drift when being under voltage stress and being illuminated. Such threshold voltage drift will be reflected as luminance non-uniformity in display effect.

In addition, in order to eliminate influence caused by threshold voltage difference of the driving transistor, the design of the configuration of the pixel circuit in the pixel circuit of the existing AMOLED is generally more complex, which directly results in a decrease of production yield of the pixel circuit of AMOLED.

Therefore, in order to solve the above problem, the present disclosure has an urgent need for providing a pixel driving unit and a driving method thereof, and a pixel circuit.

SUMMARY

According to one aspect of the present disclosure, there is provided a pixel driving circuit, comprising: a data line for providing a data voltage; a gate line for providing a scanning voltage; a first power supply line for providing a first power supply voltage; a second power supply line for providing a second power supply voltage; a light emitting device connected to the second power supply line; a driving transistor connected to the first power supply line; a storage capacitor having a first terminal connected to a gate of the driving transistor and configured to transfer information including the data voltage to the gate of the driving transistor; a resetting unit connected to the first power supply line and the storage capacitor and configured to reset a voltage across two terminals of the storage capacitor as a predetermined signal voltage; a data writing unit connected to the gate line, the data line and a second terminal of the storage capacitor and configured to write the information including the data voltage into the second terminal of the storage capacitor; a compensating unit connected to the gate line, the first terminal of the storage capacitor and the driving transistor and configured to write information including a threshold voltage of the driving transistor and information of the first power supply voltage into the first terminal of the storage capacitor; a light emitting control unit connected to the first power supply line, the second terminal of the storage capacitor, the driving transistor and the light emitting device and configured to write the first power supply voltage into the second terminal of the storage capacitor and control the driving transistor to drive the light emitting device to emit light, wherein the driving transistor is configured to control a current flowing into the light emitting device according to information including the data voltage, the threshold voltage of the driving transistor and the first power supply voltage under a control of the light emitting control unit.

Alternatively, the resetting unit comprises a resetting control line, a resetting signal line, a first transistor and a second transistor, wherein the first transistor has a gate connected to the resetting control line, a source connected to the resetting signal line and a drain connected to the first terminal of the storage capacitor, and is configured to write a resetting signal line voltage into the first terminal of the storage capacitor; and the second transistor has a gate connected to the resetting control line, a source connected to the first power supply line and a drain connected to the second terminal of the storage capacitor, and is configured to write the first power supply voltage into the second terminal of the storage capacitor.

Alternatively, the first transistor and the second transistor are P type transistors.

Alternatively, the data writing unit comprises a fourth transistor having a gate connected to the gate line, a source is connected to the data line, and a drain connected to the second terminal of the storage capacitor and configured to write the data voltage into the second terminal of the storage capacitor.

Alternatively, the fourth transistor is a P type transistor.

Alternatively, the compensating unit comprises a third transistor having a gate connected to the gate line, a source connected to the first terminal of the storage capacitor, and a drain connected to the drain of the driving transistor and configured to write the information including the threshold voltage of the driving transistor and the information of the first power supply voltage into the first terminal of the storage capacitor.

Alternatively, the third transistor is a p type transistor.

Alternatively, the light emitting control unit comprises a light emitting control line, a fifth transistor and a sixth transistor, wherein the fifth transistor has a gate connected to the light emitting control line, a source connected to the first power supply line and a drain connected to the second terminal of the storage capacitor, and is configured to write the first power supply voltage into the second terminal of the storage capacitor and transfer the first power supply voltage to the gate of the driving transistor by the storage capacitor; and the sixth transistor has a gate connected to the light emitting control line, a source connected to the light emitting device and a drain connected to the drain of the driving transistor, and is configured to control the light emitting device to emit light, the driving transistor being configured to control the magnitude of the current flowing into the light emitting device according to the information including the data voltage, the threshold voltage of the driving transistor and the first power supply voltage under the control of the light emitting control unit.

Alternatively, the fifth transistor and the sixth transistor are P type transistors.

Alternatively, the driving transistor is a P type transistor.

The present disclosure further provides a driving method of the pixel driving circuit according to any one of the above, comprising following processes: in a resetting phase, resetting the voltage across the two terminals of the storage capacitor as a predetermined voltage by the resetting unit; in a data voltage writing phase, writing the data voltage into the second terminal of the storage capacitor by the data writing unit, and writing information including the threshold voltage of the driving transistor and the information of the first power supply voltage into the first terminal of the storage capacitor by the compensating unit; in a light emitting phase, writing the first power supply voltage into the second terminal of the storage capacitor by the light emitting control unit, transferring information including the data voltage and the first power supply voltage to the gate of the driving transistor by the storage capacitor, the driving transistor controlling the current flowing into the light emitting device according to the information including the data voltage, the threshold voltage of the driving transistor and the first power supply voltage under the control of the light emitting control unit, so as to drive the light emitting device to emit light.

Alternatively, in the resetting phase, the resetting unit resets the voltages at the two terminals of the storage capacitor as the resetting signal line voltage and the first power supply voltage, respectively.

According to another aspect of the present disclosure, there is further provided an array substrate comprising the pixel driving circuit described above.

According to another aspect, there is further provided a display apparatus comprising the array substrate described above.

In the pixel driving unit of the embodiments of the present disclosure, through the configuration of connecting the gate and drain of the driving transistor (when the gate controlling signal is turned on, the gate and drain of the driving transistor are connected by the third switching transistor), the drain of the driving transistor is made to load the first power supply voltage together with the threshold voltage of the driving transistor to the first terminal of the storage capacitor, so as to offset the threshold voltage of the driving transistor. In this way, in the process of driving the light emitting device, it can eliminate effectively the non-uniformity caused by the threshold voltage of the driving transistor per se and the image sticking phenomenon caused by the threshold voltage shift of the driving transistor, and avoid the problem of the luminance nonuniformity of the active matrix organic light emitting display transistor due to the different threshold voltages of the driving transistor between light emitting devices of different pixel driving units in the active matrix organic light emitting display transistor. At the same time, the driving effect of the pixel driving unit for the light emitting device is raised, and the quality of the active matrix organic light emitting display transistor is further improved.

DETAILED DESCRIPTION

Specific implementations of the present disclosure will be further described below in detail by combining with the accompanying figures. Embodiments illustrated below are only used to describe the principle of the present disclosure, but not used to limit the scope of the present disclosure.

It should be noted that gate of respective transistors defined in the embodiments of the present disclosure is a terminal that controls the transistors to be turned on, and source and drain thereof are two terminals other then the gate of the transistor. Herein, the source and drain are used to describe the connecting relationship of the transistor conveniently, instead of defining the flowing trend of the current. Those skilled in the art can clearly know the operating principle and state of the transistors according to their type and signal connecting manner and so on.

Figure 1:
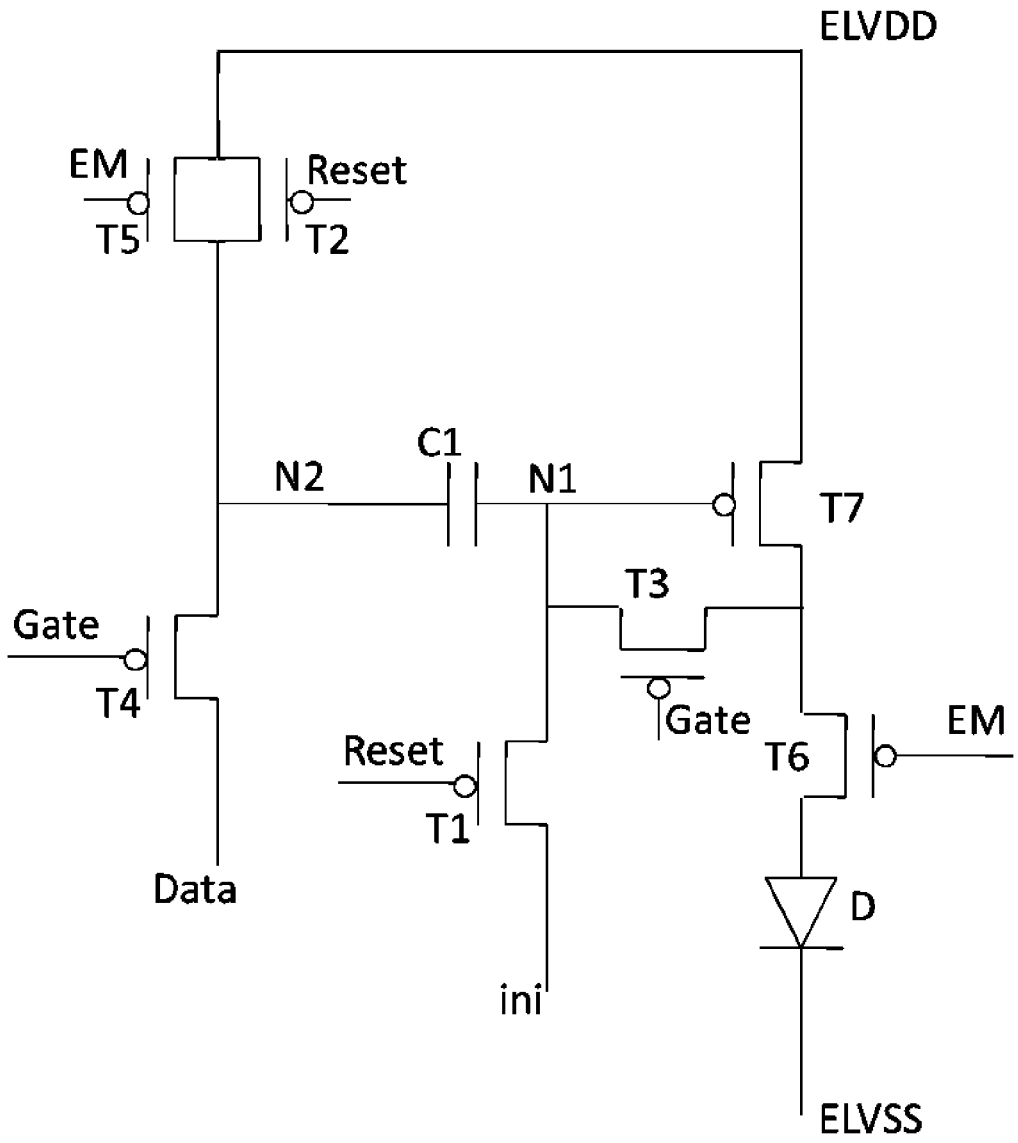
FIG. 1 is a schematic diagram of a pixel driving circuit in an embodiment of the present disclosure.

FIG. 1 illustrates a schematic diagram of a pixel driving circuit of an embodiment of the present disclosure. As shown in FIG. 1, the pixel driving circuit comprises: a data line Data, a gate line Gate, a first power supply line ELVDD, a second power supply line ELVSS, a light emitting device D, a driving transistor T7, a storage capacitor C1, a resetting unit, a data writing unit, a compensating unit and a light emitting control unit. In the circuit as shown in FIG. 1, the data line Data is used for providing a data voltage, the gate line Gate is used for providing a scanning voltage, the first power supply line ELVDD is used for providing a first power supply voltage $V_{dd}$, and the second power supply line ELVSS is used for providing a second power supply voltage $V_{ss}$.

The light emitting device D can be an organic light emitting diode. A gate of the driving transistor T7 is connected to a first terminal N1 of the storage capacitor C1, a source thereof is connected to the first power supply line ELVDD, and a drain thereof is connected to the light emitting control unit.

The resetting unit is connected to the first power supply line ELVDD and the storage capacitor C1, and is configured to reset a voltage across the storage capacitor C1 as a predetermined voltage.

The data writing unit is connected to the gate line Gate, the data line Data and a second terminal N2 of the storage capacitor C1, and is configured to write information including the data voltage into the second terminal N2 of the storage capacitor C1.

The compensating unit is connected to the gate line Gate, the first terminal N1 of the storage capacitor C1 and the driving transistor T7, and is configured to write information including a threshold voltage of the driving transistor and information of the first power supply voltage into the first terminal N1 of the storage capacitor C1.

The light emitting control unit is connected to the first power supply line ELVDD, the second terminal N2 of the storage capacitor C1, the driving transistor T7 and the light emitting device D, and is configured to write the first power supply voltage into the second terminal N2 of the storage capacitor C1 and control the driving transistor T7 to drive the light emitting device D to emit light.

The first terminal N1 of the storage capacitor C1 is connected to the gate of the driving transistor T7, and is configured to transfer the information including the data voltage to the gate of the driving transistor T7.

The driving transistor T7 is connected to the first power supply line ELVDD, and the light emitting device D is connected to the second power supply line ELVSS. The driving transistor T7 is configured to control the magnitude of the current flowing into the light emitting device D according to information including the data voltage, the threshold voltage of the driving transistor T7 and the first power supply voltage under the control of the light emitting control unit.

In the pixel driving unit of the embodiment, the threshold voltage of the driving transistor is extracted by the compensating unit, and the threshold voltage of the driving transistor T7 can be offset in the process of driving the light emitting device, so as to eliminate effectively the non-uniformity caused by the threshold voltage of the driving transistor per se and image sticking phenomenon caused by the threshold voltage drift of the driving transistor, and avoid the problem of the display luminance nonuniformity due to the threshold voltage difference of the driving transistor of different pixels in the active matrix organic light emitting display device.

In the present embodiment, the resetting unit comprises: a resetting control line Reset, a resetting signal line ini, a first transistor T1 and a second transistor T2. The first transistor T1 has a gate connected to the resetting control line Reset, a source connected to the resetting signal line ini and a drain connected to the first terminal N1 of the storage capacitor C1. The first transistor T1 is configured to write a voltage $V_{ini}$ of the resetting signal line ini into the first terminal N1 of the storage capacitor C1. The second transistor T2 has a gate connected to the resetting control line Reset, a source connected to the first power supply line ELVDD and a drain connected to the second terminal N2 of the storage capacitor C1. The second transistor T2 is configured to write a voltage $V_{dd}$ of the first power supply voltage ELVDD into the second terminal N2 of the storage capacitor C1. That is, the voltages at the two terminals of the storage capacitor C1 are reset as $V_{ini}$ and $V_{dd}$ respectively.

The data writing unit comprises a fourth transistor T4. The fourth transistor T4 has a gate connected to the gate line Gate, a source is connected to the data line Data, and a drain connected to the second terminal N2 of the storage capacitor C1. The fourth transistor T4 is configured to write the data voltage $V_{data}$ into the second terminal N2 of the storage capacitor C1. That is, the voltage at a node N2 is $V_{data}$.

The compensating unit comprises a third transistor T3. The third transistor T3 has a gate connected to the gate line Gate, a source connected to the first terminal N1 of the storage capacitor C1, and a drain connected to the drain of the driving transistor T7. The third transistor T3 is configured to write the information including the threshold voltage $V_{th}$ of the driving transistor T7 and the information of the first power supply voltage into the first terminal N1 of the storage capacitor C1. That is, the voltage at the node N1 is $V_{dd}-V_{th}$, where $V_{th}$ is the threshold voltage of the driving transistor T7.

The light emitting control unit comprises a light emitting control line EM, a fifth transistor T5 and a sixth transistor T6. The fifth transistor T5 has a gate connected to the light emitting control line EM, a source connected to the first power supply line ELVDD and a drain connected to the second terminal N2 of the storage capacitor C1. The fifth transistor T5 is configured to write the first power supply voltage $V_{dd}$ into the second terminal N2 of the storage capacitor C1, and transfer the first power supply voltage $V_{dd}$ to the gate of the driving transistor T7 by the storage capacitor C1. The sixth transistor T6 has a gate connected to the light emitting control line EM, a source connected to a first terminal of the light emitting device D and a drain connected to the drain of the driving transistor T7. The sixth transistor T6 is configured to control the light emitting device D to emit light. That is, the driving transistor T7 can make the driving current flow into the light emitting device D only when the sixth transistor 6 is turned on. The driving transistor T7 is configured to control the current flowing into the light emitting device D according to the information including the data voltage $V_{data}$, the threshold voltage $V_{th}$ of the driving transistor and the first power supply voltage $V_{dd}$ under the control of the light emitting control unit.

Figure 2:
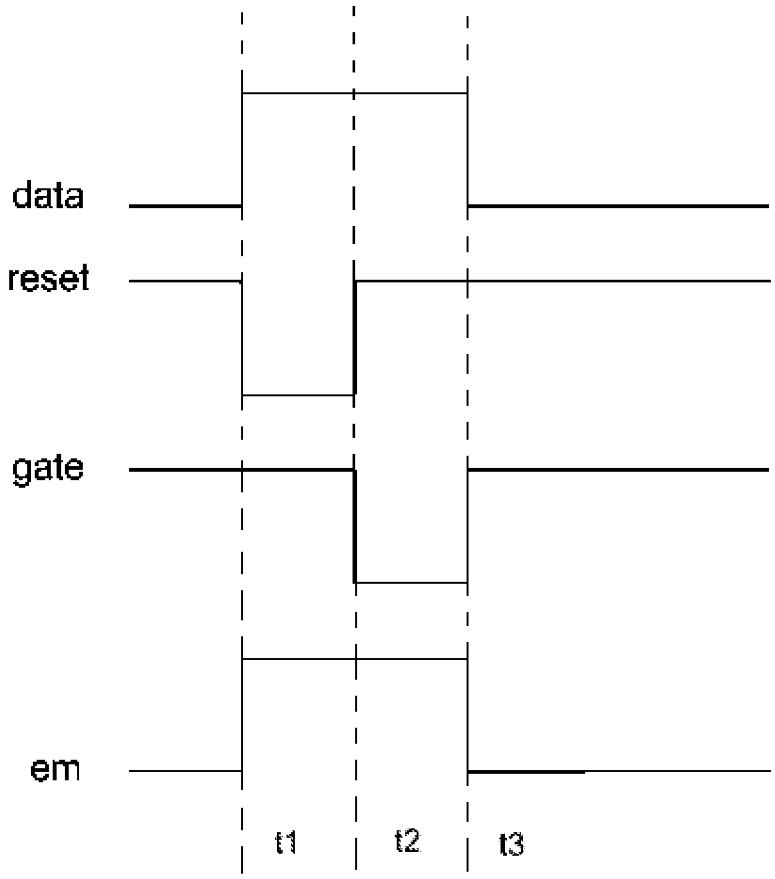
FIG. 2 is a timing diagram of the pixel driving circuit in FIG. 1

As shown in FIG. 2, the operating process of the circuit structure of the present embodiment comprises three phases:

First phase t1: in a resetting phase, after the light emitting control signal is turned off, the two terminals of the storage capacitor C1 in FIG. 1 are reset. The resetting control signal Reset is active (being low level in the embodiment as shown in FIG. 1), so that the transistors T1 and T2 are turned on, the second terminal of the storage capacitor C1, i.e., the voltage at the node N2, is the first power supply voltage $V_{dd}$, and the voltage at the first terminal of the storage capacitor C1, i.e., the voltage at the node N1, is the resetting signal line voltage $V_{ini}$. The resetting signal line voltage $V_{ini}$ and the first power supply voltage $V_{dd}$ are used for an initial state of the storage capacitor C1.

Second phase t2: the gate line signal is active (being low level in the embodiment as shown in FIG. 1), so that the transistors T3 and T4 are turned on, the data voltage $V_{data}$ is written into the node N2, and the first power supply voltage and the threshold voltage of the driving transistor are written into the node N1, i.e., $V_{dd}-V_{th}$. Now, the voltage stored in the storage capacitor is $V_{dd}-V_{th}-V_{data}$. In this phase, the transistor T3 functions as writing the information including the first power supply voltage and the threshold voltage of the driving transistor into the first terminal N1 of the storage capacitor C1, that is, extracting the threshold voltage of the driving transistor.

Third phase t3: in a light emitting phase, a signal of the light emitting control line EM is active (being low level in the embodiment as shown in FIG. 1), so that the transistors T5 and T6 are turned on, the transistor T5 is connected to the first power supply line ELVDD, the potential at the node N2 is $V_{dd}$, and the potential at the node N1 is $V_{dd}-V_{th}-V_{data}+V_{dd}$, which is the potential at the gate of the driving transistor. A potential at the source of the driving transistor is $V_{dd}$, a gate-source voltage is $V_{dd}-V_{th}-V_{data}+V_{dd}-V_{dd}$, and the current flowing into the light emitting device is $I=\frac{1}{2}\mu C_{ox}(W/L)\ (V_{gs}-V_{th})^2=\frac{1}{2}\mu C_{ox}(W/L)\ (V_{dd}-V_{data})^2$, where μ is a carrier mobility, $C_{ox}$ is a gate oxide layer capacitor, and W/L is a ratio of width to length of the driving transistor.

It can be seen from the above formula of the current flowing into the light emitting device that the current I has been already unrelated to the threshold voltage $V_{th}$ of driving transistor T7, which avoids the problem of the display luminance non-uniformity caused by the different threshold voltages of the driving transistor of different pixels in the active matrix organic light emitting display device.

The driving transistor, the first transistor, the second transistor, the third transistor, the fourth transistor, the fifth transistor and the sixth transistor in the embodiment described above are P type transistors. Of course, they can be N type transistors or a combination of P type and N type transistors, but the active signal of the gate control signal line is different.

The present disclosure provides a pixel driving method of the pixel driving circuit of the above embodiment, comprising following processes:

in a resetting phase, resetting a voltage across the storage capacitor as a predetermined voltage by the resetting unit;

in a data voltage writing phase, writing a data voltage into the second terminal of the storage capacitor by the data writing unit, and writing information including the threshold voltage of the driving transistor and information of the first power supply voltage into the first terminal of the storage capacitor by the compensating unit;

in a light emitting phase, writing the first power supply voltage into the second terminal of the storage capacitor by the light emitting control unit, transferring information including the data voltage and the first power supply voltage to the gate of the driving transistor by the storage capacitor, the driving transistor controlling the current flowing into the light emitting device to drive the light emitting device to emit light according to the information including the data voltage, the threshold voltage of the driving transistor and the first power supply voltage under the control of the light emitting control unit.

In the resetting phase, the resetting unit resets the voltages at the two terminals of the storage capacitor as the resetting signal line voltage and the first power supply voltage respectively.

Other steps of the pixel driving method can refer to the discussion of the three operating phases of the above embodiment, and thus details are not further given herein.

There provides in embodiments of the present disclosure an array substrate comprising the pixel driving circuit of the above embodiment.

There provides in embodiments of the present disclosure a display apparatus including the above array substrate. The display apparatus can be any product or element having the function of displaying, such as an AMOLED panel, a television, a digital photo frame, a mobile phone and a tablet computer and the like.

The implementations described above are just used to describe the principle of the present disclosure, but not used to limit the protection scope of the present disclosure. Those ordinary skilled in the art can make various alternations and modifications without departing from the spirit and scope of the technical solutions in the present disclosure. These alternations and modifications as well as the equivalent technical solutions thereof belong to the scope of the present disclosure. The patent protection scope of the present disclosure is defined by the claims.

The present application claims the priority of a Chinese patent application No. 201410265298.9 filed on Jun. 13, 2014. The content disclosed by the Chinese patent application is incorporated herein in full by reference as a part of the present disclosure.

What is claimed is:

1. A pixel driving circuit, comprising:

a data line for providing a data voltage;

a gate line for providing a scanning voltage;

a first power supply line for providing a first power supply voltage;

a second power supply line for providing a second power supply voltage;

a light emitting device connected to the second power supply line;

a driving transistor connected to the first power supply line;

a storage capacitor having a first terminal connected to a gate of the driving transistor and configured to transfer information including the data voltage to the gate of the driving transistor;

a resetting unit connected to the first power supply line and the storage capacitor and configured to reset a voltage across the storage capacitor as a predetermined signal voltage;

a data writing unit connected to the gate line, the data line and a second terminal of the storage capacitor and configured to write the information including the data voltage into the second terminal of the storage capacitor;

a compensating unit connected to the gate line, the first terminal of the storage capacitor and the driving transistor and configured to write information including a threshold voltage of the driving transistor and information of the first power supply voltage into the first terminal of the storage capacitor; and a light emitting control unit connected to the first power supply line, the second terminal of the storage capacitor, the driving transistor and light emitting device and configured to write the first power supply voltage into the second terminal of the storage capacitor and control the driving transistor to drive the light emitting device to emit light, wherein the driving transistor is configured to control a current flowing into the light emitting device according to information including the data voltage, the threshold voltage of the driving transistor and the first power supply voltage under a control of the light emitting control unit.

2. The pixel driving circuit according to claim 1, wherein the resetting unit comprises a resetting control line, a resetting signal line, a first transistor and a second transistor, the first transistor has a gate connected to the resetting control line, a source connected to the resetting signal line and a drain connected to the first terminal of the storage capacitor, and is configured to write a resetting signal line voltage into the first terminal of the storage capacitor; and the second transistor has a gate connected to the resetting control line, a source connected to the first power supply line and a drain connected to the second terminal of the storage capacitor, and is configured to write the first power supply voltage into the second terminal of the storage capacitor.

3. The pixel driving circuit according to claim 2, wherein the first transistor and the second transistor are P type transistors.

4. The pixel driving circuit according to claim 2, wherein the data writing unit comprises a fourth transistor having a gate connected to the gate line, a source is connected to the data line, and a drain connected to the second terminal of the storage capacitor and configured to write the data voltage into the second terminal of the storage capacitor.

5. The pixel driving circuit according to claim 4, wherein the fourth transistor is a P type transistor.

6. The pixel driving circuit according to claim 4, wherein the light emitting control unit comprises a light emitting control line, a fifth transistor and a sixth transistor, wherein the fifth transistor has a gate connected to the light emitting control line, a source connected to the first power supply line and a drain connected to the second terminal of the storage capacitor, and is configured to write the first power supply voltage into the second terminal of the storage capacitor and transfer the first power supply voltage to the gate of the driving transistor by the storage capacitor; and the sixth transistor has a gate connected to the light emitting control line, a source connected to the light emitting device and a drain connected to the drain of the driving transistor, and is configured to control the light emitting device to emit light, the driving transistor being configured to control the current flowing into the light emitting device according to the information including the data voltage, the threshold voltage of the driving transistor and the first power supply voltage under the control of the light emitting control unit.

7. The pixel driving circuit according to claim 6, wherein the driving transistor, the fifth transistor and the sixth transistor are P type transistors.

8. The pixel driving circuit according to claim 2, wherein the compensating unit comprises a third transistor having a gate connected to the gate line, a source connected to the first terminal of the storage capacitor, and a drain connected to the drain of the driving transistor and configured to write the information including the threshold voltage of the driving transistor and the information of the first power supply voltage into the first terminal of the storage capacitor.

9. The pixel driving circuit according to claim 8, wherein the third transistor is a p type transistor.

10. An array substrate comprising the pixel driving circuit according to claim 1.

11. The array substrate according to claim 10, wherein the resetting unit comprises a resetting control line, a resetting signal line, a first transistor and a second transistor, the first transistor has a gate connected to the resetting control line, a source connected to the resetting signal line and a drain connected to the first terminal of the storage capacitor, and is configured to write a resetting signal line voltage into the first terminal of the storage capacitor; and the second transistor has a gate connected to the resetting control line, a source connected to the first power supply line and a drain connected to the second terminal of the storage capacitor, and is configured to write the first power supply voltage into the second terminal of the storage capacitor.

12. The array substrate according to claim 11, wherein the first transistor and the second transistor are P type transistors.

13. The array substrate according to claim 11, wherein the data writing unit comprises a fourth transistor having a gate connected to the gate line, a source is connected to the data line, and a drain connected to the second terminal of the storage capacitor and configured to write the data voltage into the second terminal of the storage capacitor.

14. The array substrate according to claim 13, wherein the fourth transistor is a P type transistor.

15. The array substrate according to claim 13, wherein the light emitting control unit comprises a light emitting control line, a fifth transistor and a sixth transistor, wherein the fifth transistor has a gate connected to the light emitting control line, a source connected to the first power supply line and a drain connected to the second terminal of the storage capacitor, and is configured to write the first power supply voltage into the second terminal of the storage capacitor and transfer the first power supply voltage to the gate of the driving transistor by the storage capacitor; and the sixth transistor has a gate connected to the light emitting control line, a source connected to the light emitting device and a drain connected to the drain of the driving transistor, and is configured to control the light emitting device to emit light, the driving transistor being configured to control the current flowing into the light emitting device according to the information including the data voltage, the threshold voltage of the driving transistor and the first power supply voltage under the control of the light emitting control unit.

16. The array substrate according to claim 11, wherein the compensating unit comprises a third transistor having a gate connected to the gate line, a source connected to the first terminal of the storage capacitor, and a drain connected to the drain of the driving transistor and configured to write the information including the threshold voltage of the driving transistor and the information of the first power supply voltage into the first terminal of the storage capacitor.

17. The array substrate according to claim 16, wherein the third transistor is a p type transistor.

* * * * *